United States Patent [19]

Ginzburg et al.

[11] Patent Number: 5,046,344

[45] Date of Patent: Sep. 10, 1991

[54] APPARATUS FOR SIZING A WORKPIECE

[75] Inventors: Vladimir B. Ginzburg, Pittsburgh; Robert H. Ellis, Oakmont; Herbert Lemper, McMurray, all of Pa.

[73] Assignees: United Engineering, Inc.; International Rolling Mill Consultants, Inc., both of Pittsburgh, Pa.

[21] Appl. No.: 467,802

[22] Filed: Jan. 19, 1990

[51] Int. Cl.[5] ..... B21J 7/02

[52] U.S. Cl. ..... 72/20; 72/453.02; 72/406; 100/258 R

[58] Field of Search ..... 72/406, 407, 416, 186, 72/206, 453.02, 74, 20, 7; 100/258 R, 258 A

[56] References Cited

U.S. PATENT DOCUMENTS

| | | | |
|---|---|---|---|
| 2,309,944 | 2/1943 | Flowers | 100/258 A |
| 3,114,276 | 12/1963 | Uebing | 72/406 |
| 3,374,654 | 3/1968 | Uebing | 72/406 |
| 3,495,427 | 2/1970 | Balamuth | 72/56 |
| 3,580,032 | 5/1971 | Stone | 72/199 |
| 3,583,192 | 6/1971 | Kocks | 72/406 |
| 3,834,214 | 9/1974 | Kralowetz | 72/407 |
| 3,893,321 | 7/1975 | Braunwieser | 72/76 |
| 3,893,328 | 7/1975 | Blaimschein | 72/404 |
| 3,909,909 | 10/1975 | Whalen | 72/406 |
| 3,911,720 | 10/1975 | Kocks | 72/406 |
| 4,387,586 | 6/1983 | Awazuhara | 72/206 |
| 4,578,983 | 4/1986 | Kimura | 72/407 |
| 4,587,823 | 5/1986 | Eibe | 72/206 |
| 4,651,550 | 3/1987 | Nibei | 72/183 |
| 4,760,728 | 8/1988 | Nikaido | 72/407 |

FOREIGN PATENT DOCUMENTS

| | | | |
|---|---|---|---|
| 275139 | 4/1913 | Fed. Rep. of Germany | 100/258 R |
| 1126249 | 3/1962 | Fed. Rep. of Germany | 100/258 R |
| 53301 | 3/1983 | Japan | 72/206 |
| 132202 | 6/1986 | Japan | 72/206 |
| 143800 | 6/1989 | Japan | 100/258 R |

*Primary Examiner*—Daniel C. Crane

*Attorney, Agent, or Firm*—Armstrong, Nikaido, Marmelstein, Kubovcik & Murray

[57] ABSTRACT

A sizing press has a pair of opposed rotatably supported pressing tools for reducing the width of a flat metal slab. Piston cylinder assemblies rotatably oscillate the pressing tools relative to each other. Each pressing tool has first and second slab-contacting surfaces which extend in different planes. The invented method of this invention includes the steps of moving the pressing tools toward each other against the sides of a metal workpiece and reducing the width of an initial workpiece length. Thereafter, rotating the pressing tools to further reduce the width of only a portion of the initial workpiece length and to reduce the width of an adjacent workpiece length.

20 Claims, 4 Drawing Sheets

APPARATUS FOR SIZING A WORKPIECE

This invention relates to apparatus and to a method for pressing flat metal workpieces. It is particularly useful for reducing the widths of flat slabs from continuous casting machines.

Metals such as steel are continuously cast as strands having thicknesses of from about 50 mm (2") or less up to about 250 mm (10") or more and then are cut into slab lengths of up to about 9 m (28') or more. These slabs (as are flat semifinished slabs from other casting and rolling processes) must be rolled down to thinner gauges before they are useful. Sizing presses are employed in continuous casting facilities to maximize the production rate of the continuous casting machines. Sizing presses generally permit strands to be continuously cast without having to change the casting mold (which may be adjustable) each time the desired slab width changes. Also, sizing presses are commonly utilized in rolling mills to reduce yield losses caused by the formation of so-called "tongues" and "fish tails" which are frequently produced by rolling processes.

State-of-the-art sizing presses such as the press disclosed by U.S. Pat. No. 3,580,032 generally have adjustably positionable slab pressing tools for pressing a slab while it is intermittently moving between them. In this prior art press, the tools are first positioned with a screw-nut mechanism and then at least one of the pressing tools is oscillated by a hydraulic piston cylinder. The oscillating movement is synchronized with the advancement of the slab.

U.S. Pat. No. 4,578,983 discloses another press having opposed pressing tools, at least one of which is oscillated toward the other tool and synchronized with slab travel. In addition, the tools have opposed parallel and adjacent inclined slab-contacting surfaces for pressing the slabs. The tool draft of this press (like all presses) varies with the width change of the slab. However, when the tool draft is less than maximum, this press is underutilized. This is due to the fact that the full lengths of the inclined slab-contacting surfaces do not contact the slab at intermediate tool drafts and, therefore, the total pressing force (which is directly proportional to the lengths of the slab-contacting surfaces) can not be employed. Also, short contact lengths between the pressing tools and the slabs may produce rough surfaces on the slabs. In addition, when a reversing pass is required, these tools have to be reversed.

U.S. Pat. No. 4,760,728 discloses another press having oscillating synchronized pressing tools which may be advantageously used with reversing passes. They generally have opposed parallel slab-contacting surfaces disposed between opposed inclined entry side slab-contacting surfaces and opposed inclined exit side slab-contacting surfaces. However, the exit side slab-contacting surface of these tools are not used on any pass. Thus, for a given press, the tools have shortened opposed inclined slab-contacting surfaces which are more likely to produce rough surfaces than would longer pressing surfaces. In addition, the press will be underutilized at less than maximum tool draft.

Sizing presses embodying the present invention have uniquely positionable pressing tools with inclined adjacent workpiece-contacting surfaces which efficiently contact and reduce the widths of a slab whatever the tool draft may be. Also, presses embodying the present invention are particularly useful in connection with reversing lines because the tools can be repositioned in about the time it takes to reverse the direction of slab-travel. If desired, the tools can be repositioned while the tail end of the slab is still in the press after a prior pass.

Presses embodying the present invention rotatably support a pair of generally opposed pressing tools. Each pressing tool has adjacent first and second workpiece-contacting surfaces which are opposed to the adjacent first and second workpiece-contacting surfaces, respectively, of the other tool. The first and second workpiece-contacting surfaces of each tool generally extend in different substantially vertical planes. As used in this disclosure, the first workpiece-contacting surfaces refers to the first pressing surfaces to contact an advancing workpiece and the second workpiece-contacting surfaces refers to the adjacent pressing surfaces which next contact the workpiece.

Oscillating means operatively connect the pressing tools with the press for oscillating the tools toward and away from each other. Preferably, both tools are oscillated in order to most effectively reduce the workpiece width to the maximum extent and the oscillations are synchronized with the workpiece movement through the press, which is substantially continuous.

In a preferred practice of the present invention, a workpiece is positioned between the opposed pressing tools in an opened press. The tools are oscillated toward each other and against the sides of the workpiece to press an initial length of the workpiece to a lesser width. The tools are then rotated relative to each other to simultaneously further reduce the width of only a portion of the initial length of the workpiece and reduce the width of an adjacent length of the workpiece. Thus, the practice of the present invention may be employed to fully utilize the pressing tool and to produce workpieces without rough sides.

Other details, objects and advantages of the invention will become apparent as the following description of a presently preferred embodiment thereof and of a presently preferred method of practicing the invention proceeds.

FIGS. *4a–4e* are diagrams showing a preferred sequence for pressing a workpiece.

Figure 1:
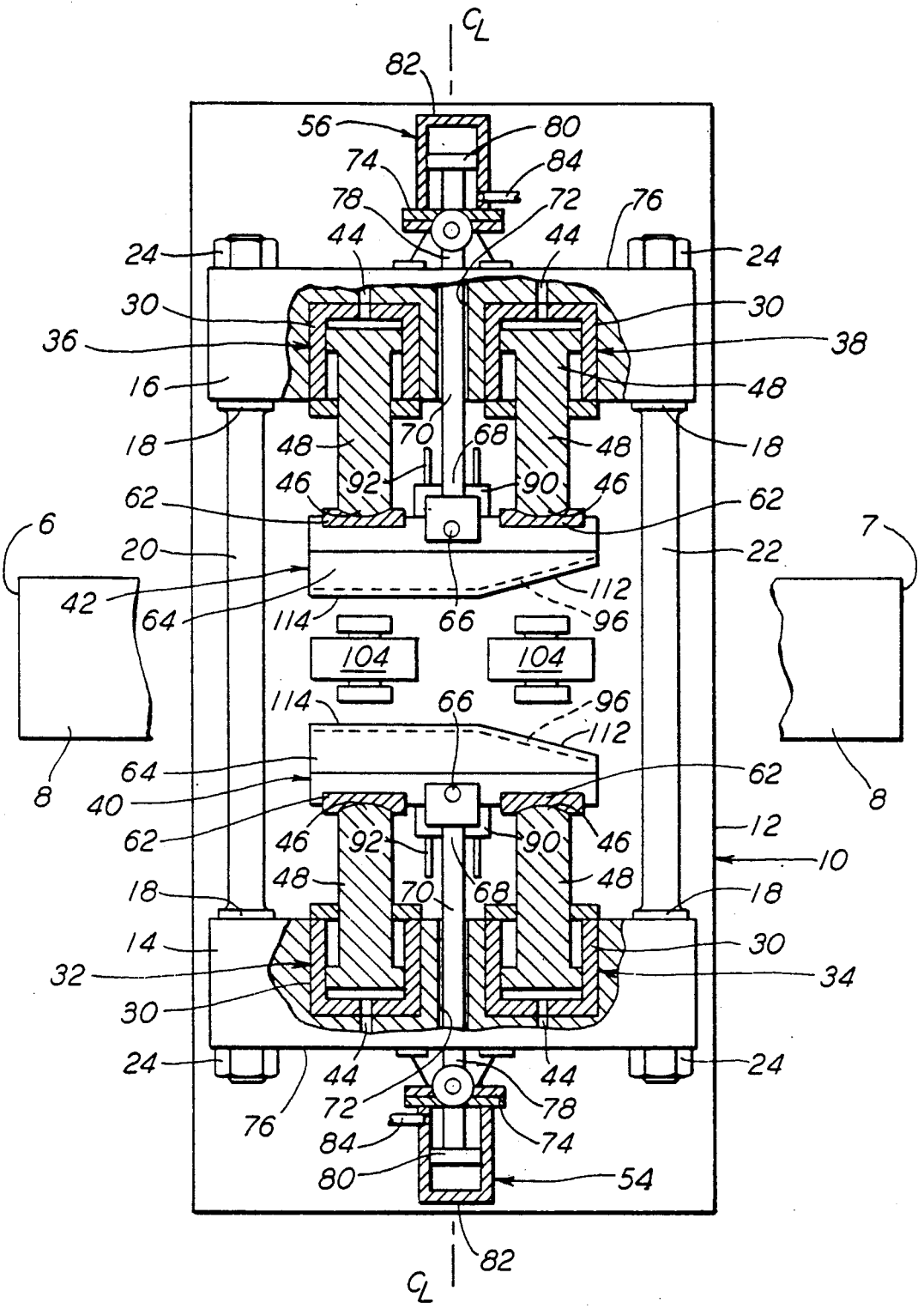
FIG. 1 is a generally schematic plan view of a (fully opened) sizing press embodying the present invention.

FIG. 1 generally shows the head end 6 and the tail end 7 of a workpiece such as a slab 8 which is being pressed to a reduced width in a sizing press 10 in one or more passes. The sizing press 10 generally has a base structure 12 which is at least partially embedded in a plant floor (not shown). The base 12 supports upright structures 14, 16 which are held in spaced relation against stops 18 of rods 20, 22 by nuts 24 threadedly engaged with the tie rods 20, 22 or by other suitable positioning means.

The upright structures 14, 16 support cylinders 30 of hydraulic piston cylinder assemblies 32–38 which position spaced apart opposed tool assemblies 40, 42 relative to each other. Preferably, and as is shown, there are two piston cylinder assemblies 32, 34 and 36, 38 operatively associated with each tool assembly 40, 42 for most effectively and accurately positioning them. However, one piston cylinder assembly (not shown) may be employed if the pressing forces involved are not great. Also, more than the four piston cylinder assemblies shown may be employed if necessary. In addition, either single-acting (as is indicated by hydraulic fluid ports 44) or double-acting (not shown) piston cylinder assemblies may be employed. Generally speaking, single acting assemblies will normally function very well in the embodiments of the invention shown in FIG. 1 and they are inherently simpler and less costly than are double-acting assemblies. Electrically driven screw-down systems (not shown) may be employed in place of hydraulic systems, but hydraulic systems are preferred because they generally have quicker response times than do electrical systems.

Each tool assembly 40, 42 is urged against the distal ends 46 of oscillating hydraulic pistons 48 of the associated hydraulic piston cylinder assemblies 32, 34 or 36, 38 by a pull back assembly 54 or 56, respectively. Each of the distal piston ends 46 slidably engages a bearing pad 62 of a tool holder 64 which is rotatably connected by a pin 66 to one end 68 of a pull back rod 70 connected to one of the upright structures 14, 16. Each pull back rod 70 extends through a bore 72 in one of the uprights 14, 16 to a mounting bracket 74 on its outerside 76. The distal end 78 of each pull back rod 70 is connected to a piston 80 of a hydraulic piston cylinder assembly 82 which is pivotally mounted on the bracket 74. Each pull back piston cylinder assembly 82 may be single-acting (as is indicated by hydraulic fluid port 84) or double-acting (not shown). Normally, the pressures in the pull back assemblies 82 are maintained at a nominal constant pressure sufficient to urge the tool assemblies 40, 42 against the pistons 48 and yet to permit the pull back pistons 48 to be overpowered by the operatively associated piston cylinder assemblies 32, 34 and 36, 38 oscillating the tool assemblies 40 and 42.

Figure 2:
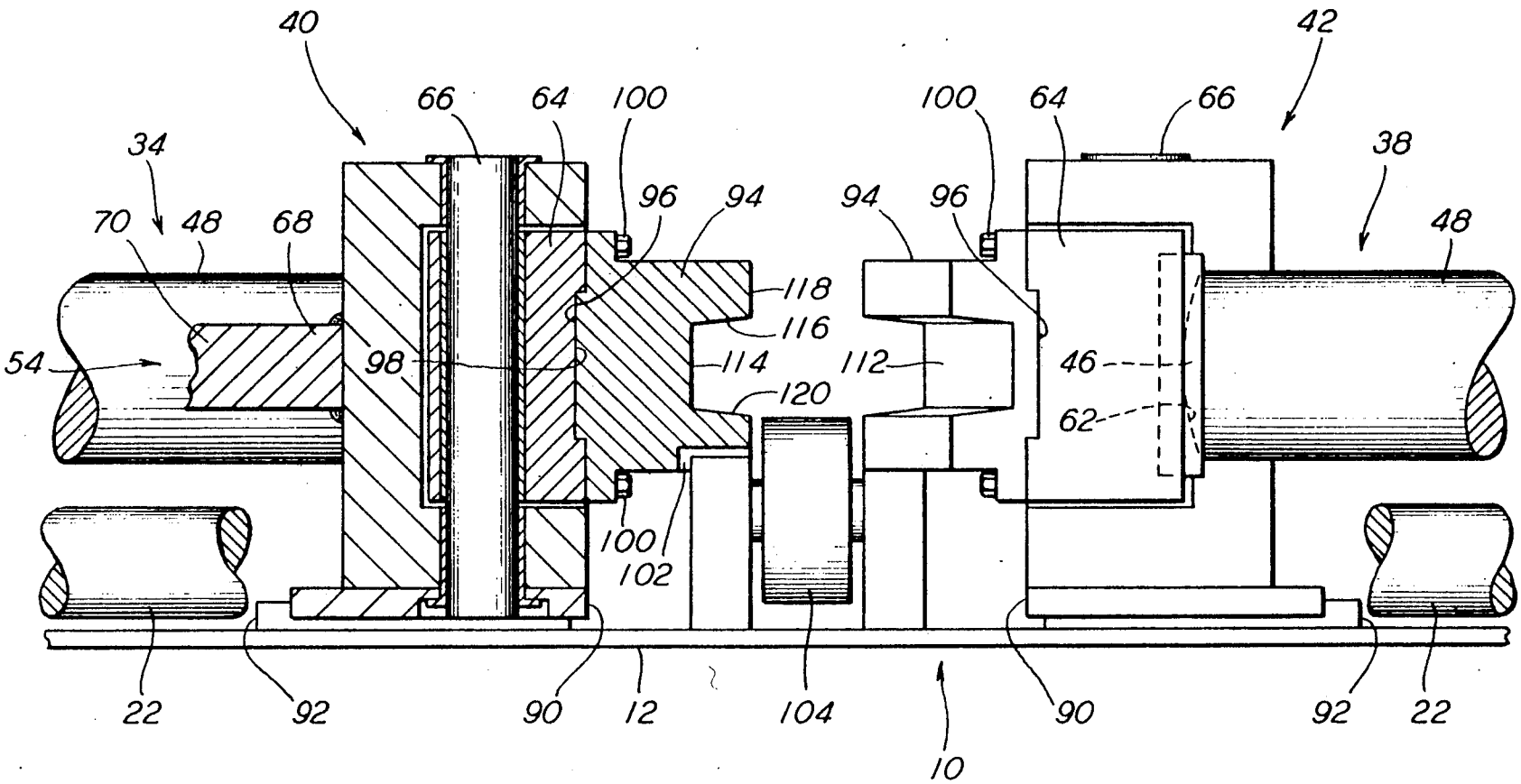
FIG. 2 is a partial front view of the (closed) sizing press of FIG. 1 generally taken along section line 2—2, which is partially sectioned along its transverse centerline and partially broken away to show the pressing tools.

As is best shown by the tool assembly 40 in FIG. 2, each tool assembly 40, 42 may be rotatably fastened by its associated pin 66 to a tool-supporting slide 90 which travels on tracks 92. Preferably, both tool assemblies 40, 42 are slidably supported as shown in order to achieve a maximum tool draft. In other embodiments of the invention (not shown), one of the tool assemblies may be rotatably fastened to the structural frame work and prohibited from sliding movement. As tool assembly 40 best shows, a pressing tool 94 is aligned with each tool holder 64 by a raised key 96 which fits into a keyway 98 in the tool holder 64. Each pressing tool 94 is fastened to each tool holder 64 by rows of bolts indicated by bolts 100. Undercut portions 102 may be provided in the pressing tools 94 to accommodate one or more support rollers 104 which support the slab 8. Where particularly deep tool drafts are taken, it may be necessary to provide buckle rollers (not shown) above the support rollers 104 to support the slab 8. In addition, where deep tool drafts are taken, the support rollers 104, overhead rollers (not shown) and pinch rolls 106, 108 (shown on FIG. 3) may need to be moveably supported by piston cylinder assemblies (not shown) or other suitable means for accommodating thickening slabs.

The pressing tools generally comprise dies having opposed first slab-contacting surfaces 112 and opposed adjacent second slab-contacting surfaces 114, which surfaces 112, 114 extend in intersecting planes. Thus, only one pair of the opposed surfaces 112 or 114 will be oriented in parallel relation at a given time. As FIG. 2 shows, a preferred pressing tool configuration has a calipered profile 116 with upper prongs 118 and lower prongs 120. This structure is advantageously employed to retard buckling and dog-bone formation, both of which may be caused by deep tool drafts. Pressing tools (not shown) having flat slab contacting faces without a calipered configuration may be employed where the workpiece does not buckle.

Figure 3:
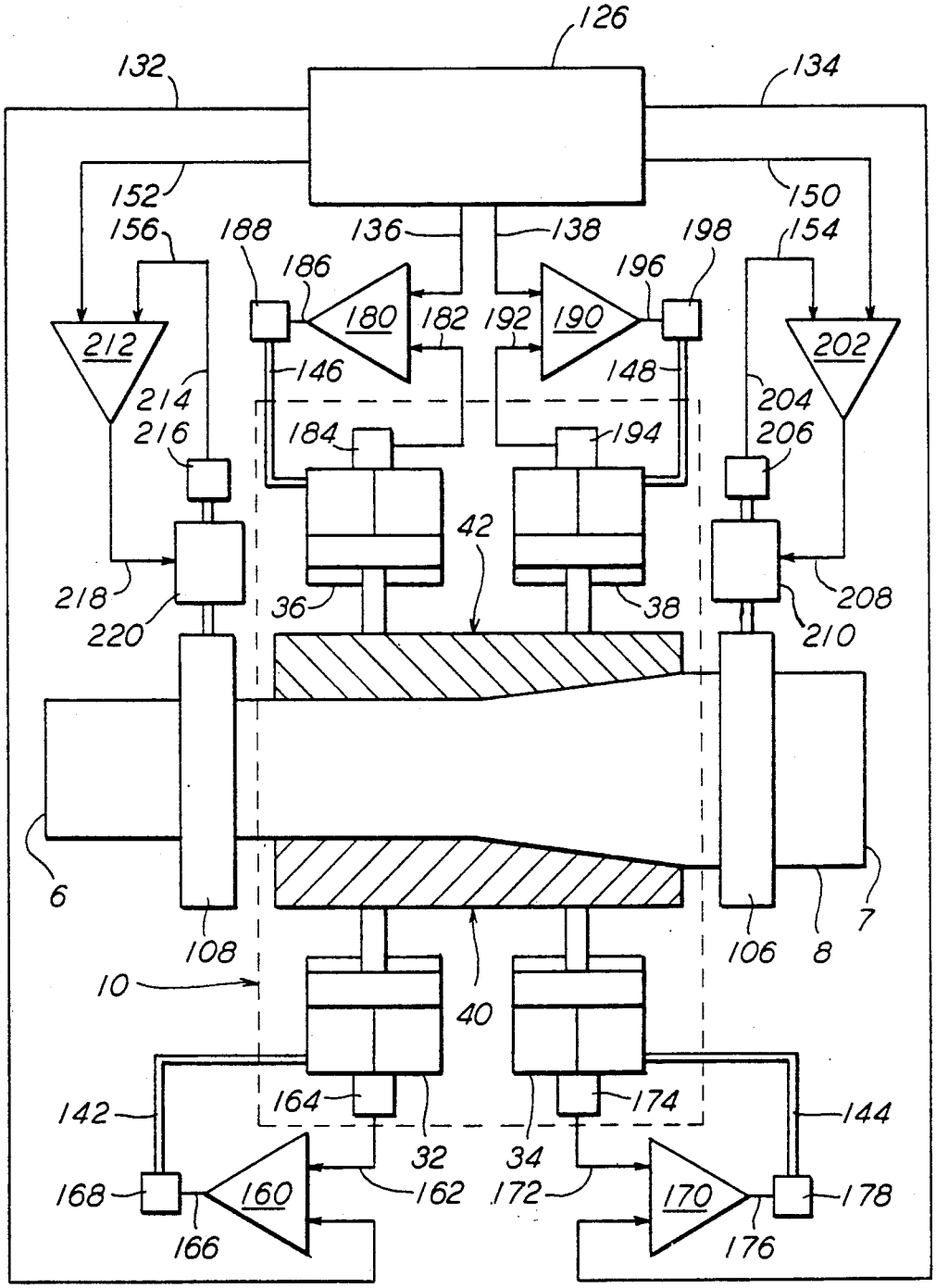
FIG. 3 is a schematic plan view of the sizing press of FIG. 1 with a block diagram showing a computer process control system for pressing a workpiece.

A process control system for operating the sizing press 10 is schematically shown in FIG. 3. A process control computer 126 receives input data such as tool sizing speed, entry thickness and width of the slab, exit thickness and width of the slab, and like equipment and process information from a supervisory computer (not shown) or other source. The process computer 126 determines the appropriate settings for the sizing press 10 and appurtenant apparatus such as pinch rolls 106, 108 and the like. It then outputs reference signals on lines 132–138 to control loops 142–148 controlling the oscillating movements of the tool positioning piston cylinder assemblies 32–38 and reference signals on lines 150, 152 to control loops 154, 156 controlling the pinch rolls 106, 108.

The reference signals on line 132 is fed to a regulator 160 in pressing tool control loop 142. The regulator 160 compares the reference signal with a feedback signal on line 162 from a position (or a pressure) transducer 164 and then outputs an error signal on line 166 to a servovalve 168 which controls the hydraulic fluid in the piston cylinder assembly 32. Similarly, the reference signals on lines 134–138 are fed to regulators 170, 180, 190 in the other pressing tool control loops 144–148. These regulators 170, 180, 190 compare the reference signals with feedback signals on lines 172, 182, 192 from position (or pressure) transducers 174, 184, 194 and then output error signals on lines 176, 186, 196 to servovalves 178, 188, 198 which control hydraulic fluid in the piston cylinder assemblies 34, 36, 38.

The reference signal on line 150 is fed to a regulator 202 in entry pinch roll control loop 154. The regulator 202 compares a feedback signal on line 204 from an angular position transducer 206 and then outputs an error signal on line 208 to a motor 210 controlling the entry side pinch roll 106. Similarly, the reference signal on line 152 is fed to a regulator 212 in exit pinch roll control loop 156. The regulator 212 compares a feedback signal on line 214 from an angular position transducer 216 and then outputs an error signal on line 218 to a motor 220 controlling the exit side pinch roll 108.

Figure 4A:
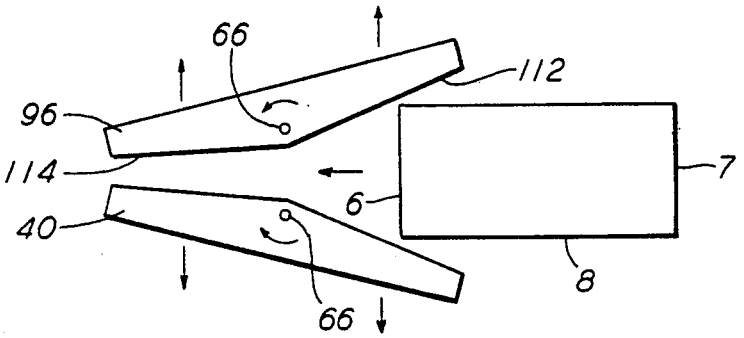

The process computer 126 synchronizes the movements of the slab 8 with the movement of the pressing tools 96. Referring to FIG. 4(*a*), the slab 8 is first advanced to a position between the opposed pressing tools 96. Normally, the head end 6 of the slab 8 will be advanced to a position between the opposed second slab-contacting surfaces 114. FIG. 4*a*, however, shows a not uncommon situation where the head end 6 of the slab 8 is wider than the full open position of the press. In this situation, the head end 6 is advanced to a position between the opposed first surfaces 112. In the embodiment of the invention as shown, the pressing tools 96 have been rotated (about pins 66 by piston cylinder assemblies 32–38) such that the opposed second slab-contacting surfaces approach each other and the opposed first slab-contacting surfaces may be opened to a greater extent. The pressing tools 96 may then be moved toward each other and counter rotated to reduce the width of the head end 6 (in one or more steps) to a width dimension which will permit the head end 6 to be advanced to a position between the opposed second slab-contacting surfaces (which steps are not shown).

Figure 4B:
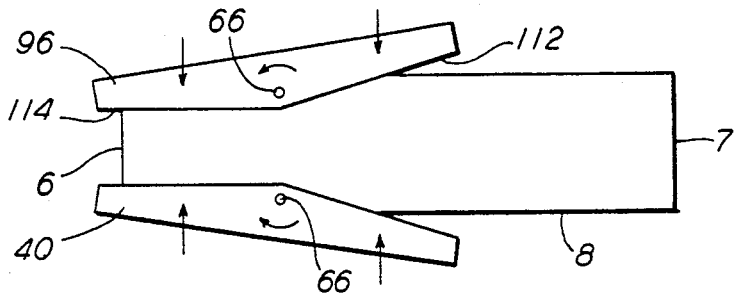
Figure 4C:
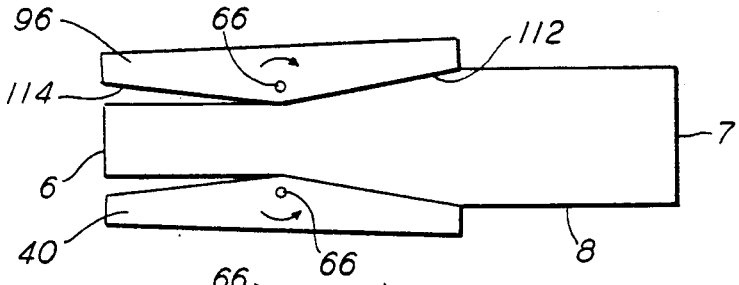
Figure 4D:
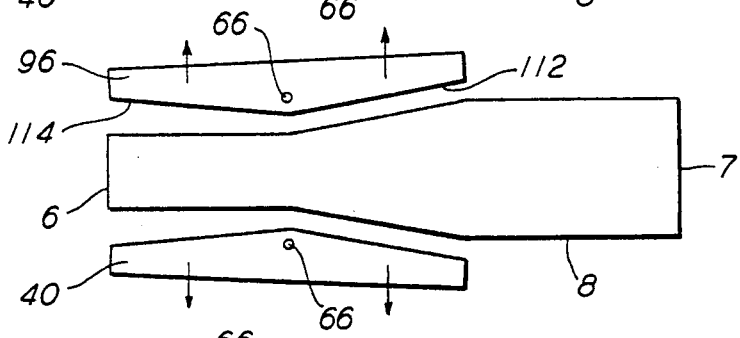
Figure 4E:
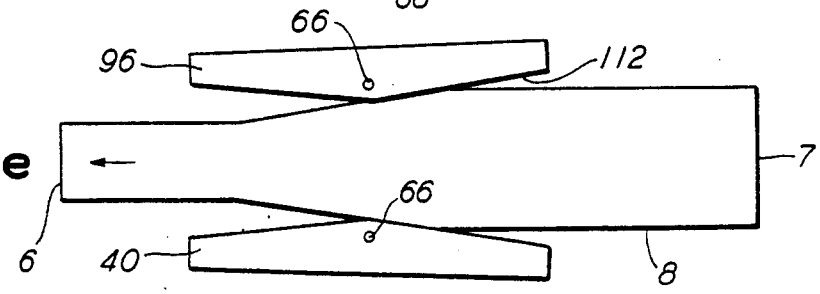

Once the head end 6 of the slab 8 is advanced to a position between the second slab-contacting surfaces 114, the pressing tools 96 are rotated to orient the opposed second slab-contacting 14 in mutually parallel relation and the pressing tools 96 are then moved toward each other to press the slab 8 to a narrower width. If less than the maximum tool draft is taken (as is shown by FIG. 4*b*) a portion of the opposed first slab-contacting surfaces 112 is not utilized and, therefore, the sizing press 10 is underutilized. Thus, the tools 96 are counterrotated to a position where substantially all of the first slab-contacting surfaces 112 contact the slab 8 for maximum utilization of the press 10 (FIG. 4*c*). The tools 96 are then oscillated away from each other (FIG. 4*d*) and the slab 8, and the slab 8 is then advanced (FIG. 4*e*). The cycle is repeated until the entire slab 8 has been sized. When a reversing pass is employed, the sequence described above reverses such that the opposed second slab-contacting surfaces are then on the entry side of the sizing press and the opposed first slab-contacting surfaces are then on the exit side of the sizing press.

The sizing press shown in the figures will size a 8.5 m (28') long 225 mm (9") thick steel slab having widths of up to 1.5 m (60") or more in less than a minute per pass with a maximum tool draft of 150 mm (6") or more. As discussed above, such a press provides substantially greater tool contact lengths than do similar prior art presses which do not have rotatable tools. The following table shows a calculated comparison of the total relative slab-contacting length of the opposed first and second slab-contacting surfaces 112 and 114 (as a ratio of total actual contact length of both surfaces at a given tool draft to a theoretical contact length of both surfaces at a maximum tool draft of 150 mm (6")) of presses embodying the present invention with prior art presses employing similar nonrotatable tools, such as the press disclosed in U.S. Pat. No. 4,578,983:

| width draft | | prior art | present |
|---|---|---|---|
| (mm) | (inch) | press | invention |
| 25 | 1 | 0.333 | 1.167 |
| 50 | 2 | 0.667 | 1.333 |
| 75 | 3 | 1.000 | 1.500 |
| 100 | 4 | 1.333 | 1.667 |
| 125 | 5 | 1.667 | 1.833 |
| 150 | 6 | 2.0 | 2.000 |

The maximum value of "2" at 150 mm (6") indicates that the total length of both opposed second slab-contacting surfaces contact the slab 8 at maximum tool drafts. The table shows that press utilization varies substantially with the actual tool draft. Thus, for example, at tool drafts of 50% or less of the maximum draft, a press embodying the present invention utilizes 50% or more pressing force across the first slab-contacting surfaces than does the prior art press. In addition, these two presses are calculated to have substantially the sam sizing (tool draft) speed.

While a certain presently preferred embodiment of the present invention and a method of practicing it have been described it is to be distinctly understood that the invention is not limited thereto, but may be variously embodied within the scope of the following claims.

What is claimed is:

1. A sizing press for reducing a width dimension of a metal workpiece, said sizing press comprising:

a. a pair of generally axially opposed pressing tools rotatably supported on said sizing press, each pressing tool including a first workpiece-contacting surface and an adjacent second workpiece-containing surface, said first surface and said second surface extending outwardly and rearwardly thereby positioning said first surface and said second surface in different planes;

b. an oscillating means supported on said sizing press and operatively connected with at least one of said pair of pressing tools for oscillating said opposed pressing tools toward and away from one another, said oscillating means includes at least two force transmitting piston cylinder assemblies, one of said two force transmitting piston cylinder assemblies engaging said pressing tools behind said first surface adjacent a first end thereof and a second of said two force transmitting piston cylinder assemblies engaging said pressing tool behind said second surface adjacent a second end thereof; and c. at least one feed means positioned on said sizing press for successively feeding such workpiece between said pair of pressing tools during operation of said sizing press.

2. A sizing press, according to claim 1, wherein each of said pair of pressing tools is oscillated.

3. A sizing press, according to claim 1, wherein said at least one feed means is a pair of pinch rolls.

4. A sizing press, according to claim 1, wherein said sizing press includes a pair of feed means positioned adjacent an entry side and an exit side of said sizing press for feeding said workpiece between said pressing tools.

5. A sizing press, according to claim 4, wherein said pair of feed means are pinch rolls.

6. A sizing press, according to claim 5, wherein said sizing press further includes a process control system.

7. A sizing press, according to claim 6, wherein said process control system includes:

a. a process control computer;

b. means for inputting predetermined critical data to said computer; and c. means for outputting reference control signals from said computer to at least said at least two force transmitting assemblies and said at least one feed means.

8. A sizing press, according to claim 7, wherein said process control system further include means for providing feedback control signals.

9. A sizing press, according to claim 1, wherein said pressing tools are rotatably supported on said sizing press by a pin extending through an aperture formed intermediate each end of said pressing tools.

10. A sizing press, according to claim 1, wherein said pressing tools are rotatably supported on said sizing press by a ledge portion formed on said pressing tool which enables connection of said pressing tool to a rotatable tool holder positioned on said sizing press.

11. A sizing press, according to claim 10, wherein said connection of said pressing tools to said tool holder is accomplished by a plurality of bolts.

12. A sizing press, according to claim 1, wherein a surface on said pressing tool engaged by at least one of said two force transmitting assemblies is recessed.

13. A sizing press, according to claim 12, wherein both surfaces on said pressing tool engaged by said two force transmitting assemblies are recessed.

14. A sizing press, according to claim 1, wherein said pressing tools include a calipered profile and said pressing tools further include upper and lower prongs extending outwardly from said first surface and said second surface.

15. A sizing press, according to claim 1, wherein said sizing press further includes at least one workpiece support roll positioned on said sizing press intermediate said pair of press tools.

16. A sizing press, according to claim 15, wherein said pressing tools further include an undercut portion to accommodate said support roll.

17. A sizing press, according to claim 1, wherein said sizing press further includes a slidably support for said pressing tools.

18. A sizing press, according to claim 1, wherein said piston cylinder assemblies are operatively connected to and controlled by servovalves.

19. A sizing press according to claim 8, wherein said piston cylinder assemblies are operatively connected to and controlled by servovalves.

20. A sizing press, according to claim 19, wherein said servovalves are operative in response to said reference control signals and said feedback control signals.

* * * * *